US007878778B2

(12) United States Patent
Shimizu et al.

(10) Patent No.: US 7,878,778 B2
(45) Date of Patent: Feb. 1, 2011

(54) ROTARY COMPRESSOR HAVING MAIN BEARING INTEGRALLY FORMED WITH CYLINDER OR PISTON SERVING AS FIXED SIDE

(75) Inventors: Takashi Shimizu, Sakai (JP); Yoshitaka Shibamoto, Sakai (JP); Kazuhiro Furusho, Sakai (JP); Takazou Sotojima, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 343 days.

(21) Appl. No.: 12/090,512

(22) PCT Filed: Oct. 19, 2006

(86) PCT No.: PCT/JP2006/320815

§ 371 (c)(1),
(2), (4) Date: Apr. 17, 2008

(87) PCT Pub. No.: WO2007/046457

PCT Pub. Date: Apr. 26, 2007

(65) Prior Publication Data

US 2009/0238705 A1 Sep. 24, 2009

(30) Foreign Application Priority Data

Oct. 20, 2005 (JP) ..... 2005-305884

(51) Int. Cl.
*F03C 2/00* (2006.01)
*F04C 18/00* (2006.01)
*F04C 2/00* (2006.01)

(52) U.S. Cl. ..... 418/59

(58) Field of Classification Search ..... 418/58, 418/59, 209, 249
See application file for complete search history.

(56) References Cited

U.S. PATENT DOCUMENTS 1,229,676 A * 6/1917 Tice ..... 418/59
2005/0008519 A1 * 1/2005 Masuda et al. ..... 418/59

FOREIGN PATENT DOCUMENTS

JP 60 090584 U * 6/1985
JP 61-151090 U 9/1986
JP 06-288358 A 10/1994
JP 10-131879 A 5/1998
JP 2000-170677 A 6/2000

* cited by examiner

*Primary Examiner*—Theresa Trieu
(74) *Attorney, Agent, or Firm*—Global IP Counselors

(57) ABSTRACT

A rotary compressor includes a fixed side and a movable side that is eccentrically movable relative to the fixed side. The movable side moves in response to operation of a drive mechanism, which rotates a drive shaft. The fixed side has a main bearing formed as a unitary part. A cylinder may serve as the movable side, which is coupled through an eccentric part to the drive shaft. The drive shaft is supported by the main bearing. With such an arrangement, a ring-shaped piston may serve as the fixed side, which is formed integrally with the main bearing in a front head.

6 Claims, 8 Drawing Sheets

ROTARY COMPRESSOR HAVING MAIN BEARING INTEGRALLY FORMED WITH CYLINDER OR PISTON SERVING AS FIXED SIDE

CROSS-REFERENCE TO RELATED APPLICATIONS

This U.S. National stage application claims priority under 35 U.S.C. §119(a) to Japanese Patent Application No. 2005-305884, filed in Japan on Oct. 20, 2005, the entire contents of which are hereby incorporated herein by reference.

TECHNICAL FIELD

The present invention generally relates to compressors of the rotary type. Specifically this invention relates to a rotary compressor in which a ring-shaped piston is arranged in a ring-shaped cylinder chamber of a cylinder so as to divide the cylinder chamber into an outer cylinder chamber and an inner cylinder chamber and in which the cylinder and the ring-shaped piston are rotated eccentrically relative to each other.

BACKGROUND ART

In the past, as the type of rotary compressor having a plurality of cylinder chambers in the same plane, compressors configured such that their pistons and cylinders are rotated eccentrically relative to each other for the compression of refrigerant have been known in the art.

There is disclosed, for example, in JP-A-H06-288358 (herein after referred to as the patent document), a compressor (see FIG. 8 and FIG. 9 which is a cross-sectional view taken along line X-X in FIG. 8). This compressor (100) includes a hermetically sealed casing (110) which contains therein a compression mechanism (120) and an electric motor (not shown) severing as a drive mechanism for driving the compression mechanism (120).

The compression mechanism (120) has a cylinder (121) having a cylinder chamber (C1, C2) in the shape of a ring, and a ring-shaped piston (122) arranged in the cylinder chamber (C1, C2). The cylinder (121) has an outer cylinder part (124) and an inner cylinder part (125), which parts are arranged concentrically relative to each other, and the cylinder chamber (C1, C2) is defined between the outer cylinder part (124) and the inner cylinder part (125).

The ring-shaped piston (122) is connected through a piston base (160) in the shape of a circle to an eccentric part (133*a*) of a drive shaft (133) connected to the electric motor (not shown). In addition, the drive shaft (133) is rotatably supported by a main bearing (145*a*) of a bearing member (145) interposed between the compression mechanism (120) and the electric motor. On the other hand, the cylinder (121) is firmly secured by a fastening screw (152) to an overlying casing cover (151).

In addition, the ring-shaped piston (122) is configured such that it is rotated eccentrically relative to the center of the cylinder (121), with the outer peripheral surface being substantially in line contact through a microgap with the inner peripheral surface of the outer cylinder part (124), and with the inner peripheral surface being substantially in line contact through a microgap with the outer peripheral surface of the inner cylinder part (125).

An outer blade (123A) is arranged outside the ring-shaped piston (122). An inner blade (123B) is arranged so as to lie on an extension of the outer blade (123A). The outer blade (123A) is inserted in a blade groove formed in the outer cylinder part (124). And, the outer blade (123A) is biased inwardly in the radial direction of the ring-shaped piston (122) and its tip end is in pressure contact with the outer peripheral surface of the ring-shaped piston (122). On the other hand, the inner blade (123B) is inserted in a blade groove formed in the inner cylinder part (125). And, the inner blade (123B) is biased outwardly in the radial direction of the ring-shaped piston (122) and its tip end is in pressure contact with the inner peripheral surface of the ring-shaped piston (122).

In the way as described above, the outer blade (123A) separates the outer cylinder chamber (C1) into a high pressure chamber and a low pressure chamber. Likewise, the inner blade (123B) separates the inner cylinder chamber (C2) into a high pressure chamber and a low pressure chamber. And, in the compressor (100), as the ring-shaped piston (122) is rotated eccentrically, fluid is drawn into the low pressure chamber (C1-Lp, C2-Lp) of the cylinder chamber (C1, C2) while fluid is compressed in the high pressure chamber (C1-Hp, C2-Hp) of the cylinder chamber (C1, C2).

SUMMARY OF THE INVENTION

Problems that the Invention Seeks to Overcome

In the above-described conventional compressor, it is required that, when the ring-shaped piston is off-centered while being substantially in line contact with the cylinder, the microgap between the ring-shaped piston and the cylinder be kept at a constant interval, regardless of the eccentric position of the ring-shaped piston. The reason for such requirement is that, if the microgap expands too much, fluid will leak from between the ring-shaped piston and the cylinder, thereby leading to the possibility that the compression efficiency of the compression mechanism may drop or, on the other hand, if the microgap narrows too much, the resistance of sliding at the point of contact between the ring-shaped piston and the cylinder increases, thereby leading to the possibility that wear and seizing may occur at the contact point. Therefore, in this type of compressor, it is required that the compression mechanism should be assembled such that the center position of the cylinder (the fixed side) and the eccentric-rotation center position of the ring-shaped piston (the movable side) are made to coincide, as much as possible, with each other in the radial direction.

However, in the compression mechanism (120) disclosed in the patent document (see FIGS. 8 and 9), the ring-shaped piston (122) is supported through the drive shaft (23) by the main bearing (145*a*), and the cylinder (121) is firmly secured to the casing cover (151). In other words, in the compression mechanism (120), the eccentric-rotation center of the ring-shaped piston (122) is positioned by the main bearing (145*a*), and the center position of the cylinder (121) is determined mainly by the mount position of the cylinder (121) with respect to the casing (110). Consequently, if some errors are made in the mount position of the main bearing (145*a*) and of the cylinder (121), the possibility arises that the eccentric-rotation center of the ring-shaped piston (122) and the center of the cylinder (121) shift in the radial direction. As a result, the interval of the microgap will change in response to the eccentric position of the ring-shaped piston (122), which may lead to a drop in the compression efficiency of the compression mechanism (120) and to the possibility of causing wear/seizing at the point of contact between the ring-shaped piston (122) and the cylinder (121).

The present invention was made in view of the above-described problems. Accordingly, an object of the present invention is to inhibit, in a rotary compressor in which a cylinder and a ring-shaped piston are rotated eccentrically relative to each other, the undesirable situation where the interval of a microgap between the ring-shaped piston and the cylinder becomes varied in response to the eccentric-rotation position due to the assembly error.

Means for Overcoming the Problems

The present invention provides, as a first aspect, a rotary compressor comprising: (a) a piston mechanism (30) of the eccentric-rotation type which has a cylinder (60) with a cylinder chamber (C1, C2) in the shape of a ring; a ring-shaped piston (43) accommodated, in an eccentric manner relative to the cylinder (60), in the cylinder chamber (C1, C2), the ring-shaped piston (43) dividing the cylinder chamber (C1, C2) into an outer cylinder chamber (C1) and an inner cylinder chamber (C1, C2); and a blade (32) arranged in the cylinder chamber (C1, C2), the blade (32) dividing each of the outer and the inner cylinder chamber (C1) and (C2) into a high pressure chamber (C1-Hp, C2-Hp) and a low pressure chamber (C1-Lp, C2-Lp) and in which the cylinder (60) and the ring-shaped piston (43) are rotated eccentrically relative to each other, with one of the cylinder (60) and the ring-shaped piston (43) serving as a movable side and the other serving as a fixed side; (b) a drive shaft (23) which is coupled to either the cylinder (60) or the ring-shaped piston (43), whichever is the movable side; and (c) a drive mechanism (20) which causes the drive shaft (23) to rotate. The rotary compressor of the first aspect is characterized in that a main bearing (45) which supports in a rotatable manner the drive shaft (23) is disposed on the side of the drive mechanism (20) in the eccentric-rotation type piston mechanism (30), and in that the main bearing (45) is formed integrally with either the cylinder (60) or the ring-shaped piston (43), whichever is the fixed side.

In the first aspect of the present invention, the ring-shaped cylinder chamber (C1, C2) is divided by the ring-shaped piston (43) into the outer cylinder chamber (C1) and the inner cylinder chamber (C2). That is, in the cylinder chamber (C1, C2), the outer peripheral-side wall surface in the ring-shaped cylinder (60) and the outer peripheral surface of the ring-shaped piston (43) come into line contact with each other through a microgap while simultaneously the inner peripheral-side wall surface in the cylinder (60) and the inner peripheral surface of the ring-shaped piston (43) come into line contact with each other through a microgap. Furthermore, each of the cylinder chambers (C1) and (C2) is divided by the blade (32) into the high pressure chamber (C1-Hp, C2-Hp) and the low pressure chamber (C1-Lp, C2-Lp).

Upon the rotation of the drive shaft (23) caused by the drive mechanism (20), the cylinder (60) and the ring-shaped piston (43) are rotated eccentrically relative to each other. More specifically, in the eccentric-rotation type piston mechanism (30) in which the cylinder (60) is the fixed side, the movable-side ring-shaped piston (43) rotates eccentrically relative to the cylinder (60). On the other hand, in the eccentric-rotation type piston mechanism (30) in which the ring-shaped piston (43) is the fixed side, the movable-side cylinder (60) rotates eccentrically relative to the ring-shaped piston (43).

When, as described above, the cylinder (60) and the ring-shaped piston (43) are rotated eccentrically relative to each other, the point of contact between the cylinder (60) and the ring-shaped piston (43) is displaced in the eccentric-rotation direction. As a result, in the outer and the inner cylinder chamber (C1) and (C2), the volume of each low pressure chamber (C1-Lp, C2-Lp) is expanded while the volume of each high pressure chamber (C1-Hp, C2-Hp) is reduced. In other words, in the eccentric-rotation type piston mechanism (30), with the expansion of the volume of each low pressure chamber (C1-Lp, C2-Lp), fluid is drawn into each low pressure chamber (C1-Lp, C2-Lp) and, at the same time, with the reduction of the volume of each high pressure chamber (C1-Hp, C2-Hp), fluid is compressed in each high pressure chamber (C1-Hp, C2-Hp).

In addition, in the present invention, the drive shaft (23) is rotatably supported by the main bearing (45). Because of this, the eccentric-rotation center position of the cylinder (60) or the ring-shaped piston (43), whichever is coupled to the drive shaft (23) to be the movable side (hereinafter, referred to just as the movable part), is determined by the radial position of the main bearing (45) supporting the drive shaft (23). In addition, the cylinder (60) or the ring-shaped piston (43), whichever is the fixed side (hereinafter, referred to jus as the fixed part), is formed integrally with the main bearing (45). Accordingly, the center position of the fixed part (43, 60) is also positioned by the main bearing (45).

That is, in the conventional compressor (100) of the aforesaid patent document, the movable-side ring-shaped piston (122) is restricted by the mount position of the main bearing (145*a*), and the position of the fixed-side cylinder (121) is restricted by the mount position of the cylinder (121) with respect to the casing (110). However, in the present invention, both the position of the cylinder (60) and the position of the ring-shaped piston (43) are determined by the mount position of the main bearing (45). That is, in the present invention, the relative position relationship between the cylinder (60) and the ring-shaped piston (43) is determined by the accuracy of dimensions of each member, so that even if an errors is made in the mount position of the main bearing (45) when assembling the eccentric-rotation type piston mechanism (30), the eccentric-rotation center of the movable part (60, 43) and the center of the fixed part (43, 60) will not shift in the radial direction.

The present invention provides, as a second aspect according to the first aspect, a rotary compressor which is characterized in that the drive shaft (23) extends so as to pass through the eccentric-rotation type piston mechanism (30), in that a sub bearing (51) which supports in a rotatable manner the drive shaft (23) is disposed radially opposite, across the eccentric-rotation type piston mechanism (30), the drive mechanism (20), and in that the bearing length of the main bearing (45) is longer than the bearing length of the sub bearing (51).

In the second aspect of the present invention, the sub bearing (51) by which the drive shaft (23) is rotatably supported is provided separately from the main bearing (45). Since the sub bearing (51) is arranged opposite, across the eccentric-rotation type piston mechanism (30), the main bearing (45), the drive shaft (23) is supported, in a so-called straddle manner, by both the main bearing (45) and the sub bearing (51).

Here, the drive shaft (23) is restricted by the main bearing (45) whose bearing length is longer than that of the sub bearing (51), and the eccentric-rotation center of the movable part (60, 43) coupled to the drive shaft (23) is restricted mainly by the mount position of the main bearing (45). However, in the present invention, the main bearing (45) and the fixed part (43, 60) are formed integrally with each other, and the center of the fixed part (43, 60) is also restricted by the mount position of the main bearing (45), so that even if an error is made in the mount position of the main bearing (45), the eccentric-rotation center of the movable part (60, 43) and the center of the fixed part (43, 60) are inhibited from shifting in the radial direction.

The present invention provides, as a third aspect according to the first aspect, a rotary type which is characterized in that the bearing gap between the main bearing (45) and the drive shaft (23) is narrower than the bearing gap between the sub bearing (51) and the drive shaft (23).

In the third aspect of the present invention, it is set such that the bearing gap for the main bearing (45) is narrower than the bearing gap for the sub bearing (51). Accordingly, in the present invention, the eccentric-rotation center position of the movable part (60, 43) is determined practically by the main bearing (45). Consequently, even if an error is made in the mount position or the machining accuracy of the sub bearing (51), the sub bearing (51) and the drive shaft (23) will not interfere with each other, thereby effectively inhibiting the eccentric-rotation center position of the movable part (60, 63) and the center position of the fixed part (43, 60) from shifting in the radial direction.

The present invention provides, as a fourth aspect according to any one of the first to the third aspect, a rotary compressor which is characterized in that the rotary compressor includes a casing (10) which accommodates therein the eccentric-rotation type piston mechanism (30), the drive shaft (23), and the drive mechanism (20) and which is filled up with fluid discharged from the eccentric-rotation type piston mechanism (30); in that a discharge pipe (15), for leading the discharged fluid out of a space extending from the eccentric-rotation type piston mechanism (30) towards the drive mechanism (20) in the casing, is connected to the casing (10); and in that a fixed-side member (40) including the cylinder (60) or the ring-shaped piston (43), whichever is the fixed side, and the main bearing (45) which are integrally formed with each other, is provided with a discharge port (36, 37) of the eccentric-rotation type piston mechanism (30).

The rotary compressor of the fourth aspect is formed by a so-called high-pressure dome type compressor in which the casing (10) is filled up with fluid discharged from the eccentric-rotation type piston mechanism (30). Fluid compressed in the eccentric-rotation type piston mechanism (30) is discharged outside from the discharge port (36, 37) formed in the eccentric-rotation type piston mechanism (30). Here, the fixed-side member (40) is arranged on the side of the drive mechanism (20), and the discharged fluid is discharged to the space on the side of the drive mechanism (20) in the casing (10). Then, the discharged fluid flows out, by way of the discharge pipe (15) connected to the space on the side of the drive mechanism (20) in the casing (10), to outside the casing (10).

In the present invention, both the discharge port (36, 37) and the discharge pipe (15) face the space on the side of the drive mechanism (20), so that fluid discharged from the discharge port (36, 37) is delivered, without flowing around the periphery of the eccentric-rotation type piston mechanism (30), to outside the casing (10) from the discharge pipe (15). In other words, in the present invention, the discharged fluid heated to high temperature is delivered, without flowing around the periphery of the cylinder (60), to outside the casing (10). This inhibits fluid in each low pressure chamber (C1-Lp, C2-Lp) from being heated by the discharged fluid.

ADVANTAGEOUS EFFECTS OF THE INVENTION

In the present invention, either the cylinder (60) or the ring-shaped piston (43), whichever is the fixed side (fixed-side part), is formed integrally with the main bearing (45). Consequently, in accordance with the present invention, both the radial position of the movable part (60, 43) and the radial position of the fixed part (43, 60) can be restricted by the main bearing (45). As a result, it becomes possible to inhibit the eccentric-rotation central position of the movable part (60, 43) and the center position of the fixed part (43, 60) from shifting in the radial direction. Accordingly, in accordance with the present invention, it is possible to equalize the interval of the microgap between the cylinder (60) and the ring-shaped piston (43), without the need for precise alignment of the relative position of the fixed part (43, 60) and the movable part (60, 43). This prevents fluid leakage from between the cylinder (60) and the ring-shaped piston (43) and wear/seizing at the point of contact between the cylinder (60) and the ring-shaped piston (43), thereby making it possible to enhance the reliability of the rotary compressor.

In addition, in the present invention, the main bearing (45) is disposed on the side of the drive mechanism (20) in the eccentric-rotation type piston mechanism (30). Generally, a large centrifugal force is applied, by a balancer mounted to the drive mechanism (20), to the drive shaft (23) driven by the drive mechanism (20). However, in accordance with the present invention, since the main bearing (45) is disposed near this area, this makes it possible to effectively inhibit the drive shaft (23) from undergoing deflection deformation in the radial direction.

In the second aspect of the present invention, the drive shaft (23) is supported, in a straddle manner, by both the main bearing (45) and the sub bearing (51). Consequently, in accordance with the present invention, the bearing load carrying capacity acting on the drive shaft (23) is reduced, thereby making it possible for the drive shaft (23) to rotate stably.

In addition, in the present invention, the bearing length of the main bearing (45) is set longer than the bearing length of the sub bearing (51). Consequently, the movable part (60, 43) is restricted mainly by the main bearing (45). Accordingly, it becomes possible to inhibit the undesirable situation where the position of the movable part (60, 43) is restricted by the mount position of the sub bearing (51) to thereby cause the eccentric-rotation center of the movable part (60, 43) and the center of the fixed part (43, 60) to shift in the radial direction.

Furthermore, in accordance with the third aspect of the present invention, the bearing gap of the main bearing (45) is set narrower than the bearing gap of the sub bearing (51) whereby it becomes possible to effectively inhibit the eccentric-rotation center of the movable part (60, 43) and the center of the fixed part (43, 60) from shifting in the radial direction.

In addition, in the fourth aspect of the present invention, both the discharge port (36, 37) of the eccentric-rotation type piston mechanism (30) and the discharge pipe (15) connected to the casing (10) are made to open to the space on the side of the drive mechanism (20). Therefore, in accordance with the present invention, high-temperature fluid discharged from the discharge port (36, 37) can be delivered, without passing around the periphery of the eccentric-rotation type piston mechanism (30), to outside the casing (10). This inhibits the undesirable situation where the fluid in each low pressure chamber (C1-Lp, C2-Lp) is heated by the high-temperature discharged fluid, thereby making it possible to prevent a drop in the compression efficiency of the eccentric-rotation type piston mechanism (30).

DETAILED DESCRIPTION OF THE INVENTION

Embodiments of the present invention will be described below in detail with reference to the accompanying drawings.

First Embodiment

A rotary compressor according to a first embodiment of the present invention constitutes a compressor (1) of the so-called two-cylinder type which compresses refrigerant respectively in two cylinder chambers formed in the same plane. The compressor (1) is utilized in a compression process of compressing refrigerant in the refrigeration cycle of a refrigerant circuit in an air conditioner, a refrigeration system, or the like.

Overall Configuration

Figure 1:
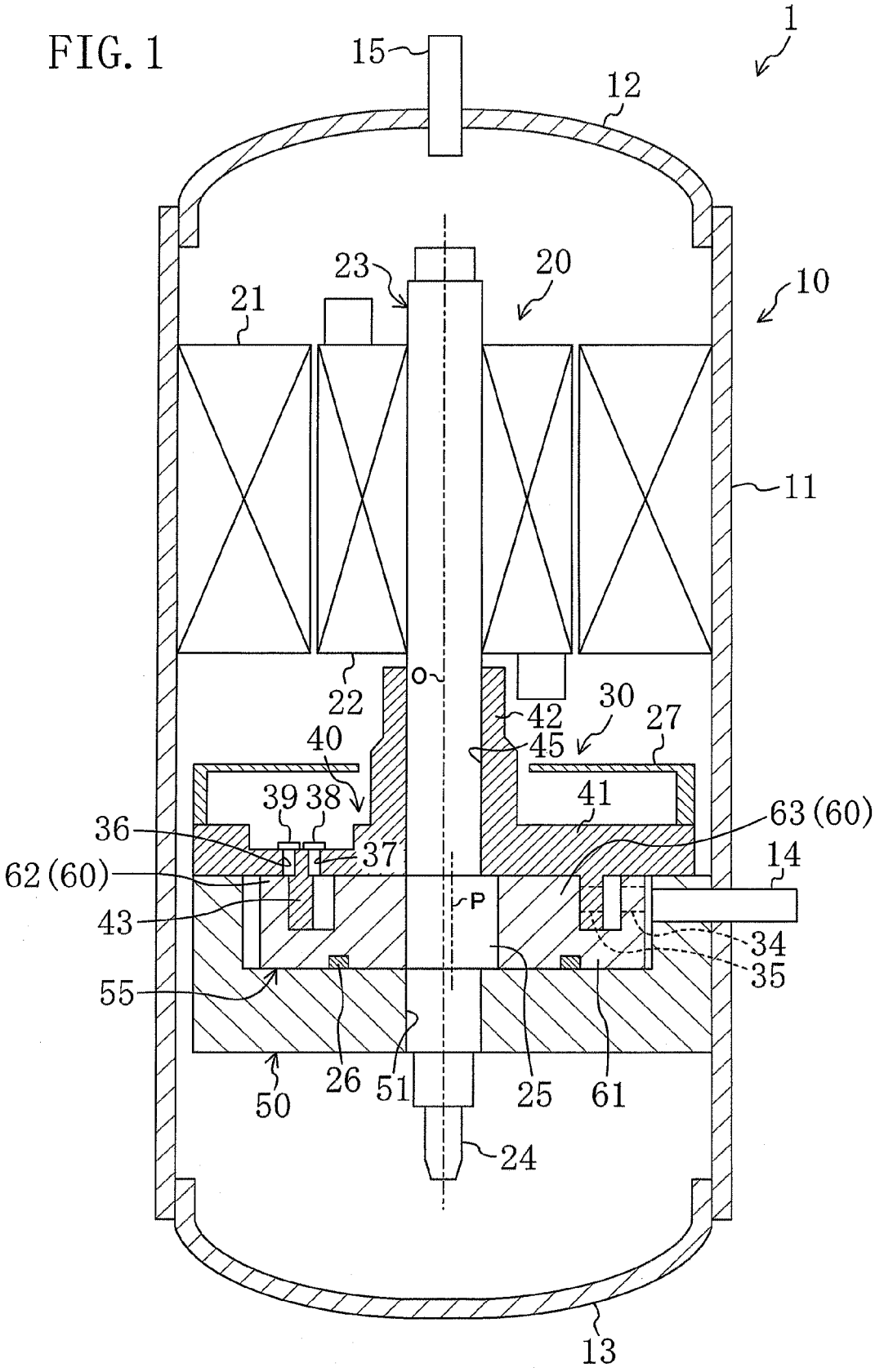
FIG. 1 is a longitudinal cross-sectional view of a compressor according to a first embodiment of the present invention.

As shown in FIG. 1, the compressor (1) includes a casing (10), an electric motor (20), and a compression mechanism (30).

The casing (10) constitutes a vertically-elongated, hermetically-sealed container. The casing (10) includes a body part (11) in the shape of a tube, an upper cover part (12) firmly secured to the upper end of the body part (11), and a lower cover part (13) firmly secured to the lower end of the body part (11). A suction pipe (14) is provided on the lower side of the body part (11) so as to pass therethrough. One end of the suction pipe (14) opens outside the casing (10) and the other end thereof opens inside the compression mechanism (30). A discharge pipe (15) is provided so as to pass through the top of the upper cover part (12). One end of the discharge pipe (15) opens to a space on the side of the electric motor (20) in the casing (10) and the other end thereof opens outside the casing (10). In addition, the internal space of the casing (10) is filled up with refrigerant (fluid) discharged from the compression mechanism (30). The compressor (1) of the present embodiment is a so-called high-pressure dome type compressor, in other words, the pressure in the casing (10) is high.

The electric motor (20) is arranged in a space on the upper side in the casing (10). The electric motor (20) is provided with a stator (21) and a rotor (22). The stator (21) is firmly secured to the inner wall of the body part (11) of the casing (10). The rotor (22) is arranged on the inner peripheral side of the stator (21). Connected to the inside of the rotor (22) is the drive shaft (23). And, the electric motor (20) constitutes a drive mechanism for rotating the drive shaft (23).

The drive shaft (23) is extended in an up and down direction so as to pass through the electric motor (20) and through the compression mechanism (30). The drive shaft (23) is rotatably supported by a main and a sub bearing (45) and (51), which bearings will be described later below. An oil supply pump (24) is disposed in the lower end of the drive shaft (23). The oil supply pump (24) pumps up lubricant accumulated on the bottom of the casing (10) and supplies it through an oil supply path (not shown) of the drive shaft (23) to each sliding part of the compression mechanism (30). In addition, an eccentric part (25) is formed on the lower side of the drive shaft (23). The eccentric part (25) is formed so as to have a greater diameter than the drive shaft (23) and is off-centered from the axial center of the drive shaft (23) by a predetermined amount.

The compression mechanism (30) of the first embodiment constitutes an eccentric-rotation type piston mechanism in which a cylinder (60) serving as a movable side rotates eccentrically relative to a ring-shaped piston (43) serving as a fixed side. The compression mechanism (30) includes a front head (40), a rear head (50), and an eccentric movable part (55).

The front head (40) constitutes a fixed-side member including a first end plate (41), a bearing member (42), and a ring-shaped piston (43) which are integrally formed with each other. The first end plate (41) is formed in the shape of a circular plate through which the drive shaft (23) passes. The bearing member (42) extends upwardly from the inner peripheral end of the first end plate (41). The drive shaft (23) passes internally through the bearing member (42), and the surface of the bearing member (42), which surface comes into sliding contact with the drive shaft on the inner peripheral side thereof, constitutes the main bearing (45). The main bearing (45) is a sliding bearing journal bearing) and the drive shaft (23) is rotatably supported by the main bearing (45). The ring-shaped piston (43) is provided so as to project downwardly from the radial intermediate position of the first end plate (41). The ring-shaped piston (43) is formed so as to have a C-shaped transverse cross-section orthogonal to the axial direction of the drive shaft (23), and the center of the ring-shaped piston (43) coincides with the axial center, O, of the drive shaft (23) (see FIG. 2).

The rear head (50) is formed in the shape of a flat tube furnished with a bottom, and its outer peripheral surface is firmly secured to the inner wall of the body part (11) of the casing (10). The drive shaft (23) is passed through the middle of the rear head (50). And, the surface of the rear head (50) which comes into in sliding contact with the drive shaft (23) in the inside thereof constitutes the sub bearing (51). The sub bearing (51) is a sliding bearing (journal bearing), and the drive shaft (23) is rotatably supported by the sub bearing (51). In addition, the rear head (50) is firmly secured, at it upper end, to the lower surface side of the first end plate (41). And, the eccentric movable part (55) is accommodated in a space blocked off by the front and the rear head (40) and (50).

The eccentric movable part (55) is formed such that it includes a second end plate (61) and a cylinder (60) which are integrally formed with each other. The second end plate (61) is positioned on the lower end side of the eccentric movable part (55) and is formed in the shape of a circular plate. Interposed between the second end plate (61) and the rear head (50) is a seal ring (26) in the shape of a circle. Also note that in the present embodiment the axial center of the seal ring (26) and the axial center of the drive shaft (23) coincide with each other. The cylinder (60) is made up of an outer cylinder part (62) and an inner cylinder part (63). The outer cylinder part (62) is formed so as to project upwardly from the outer peripheral end of the second end plate (61). The outer cylinder part (62) is formed so as to have a transverse cross-section in the shape of a ring. The inner cylinder part (63) is formed so as to project upwardly from the inner peripheral end of the second end plate (61). The inner cylinder part (63) is formed so as to have a transverse cross-section in the shape of a ring and its radial thickness dimension is larger than the outer cylinder part (62). In addition, the eccentric part (25) of the drive shaft (23) engages to the inner peripheral side of the inner cylinder part (63), and the drive shaft (23) and the cylinder (60) are coupled together. And, both the center of the outer cylinder part (62) and the center of the inner cylinder part (63) coincide with the axial center, P, of the eccentric part (25) while on the other hand the eccentric-rotation center of the cylinder (60) coincides with the axial center, O, of the drive shaft (23).

Concrete Configuration of the Compression Mechanism

Figure 2:
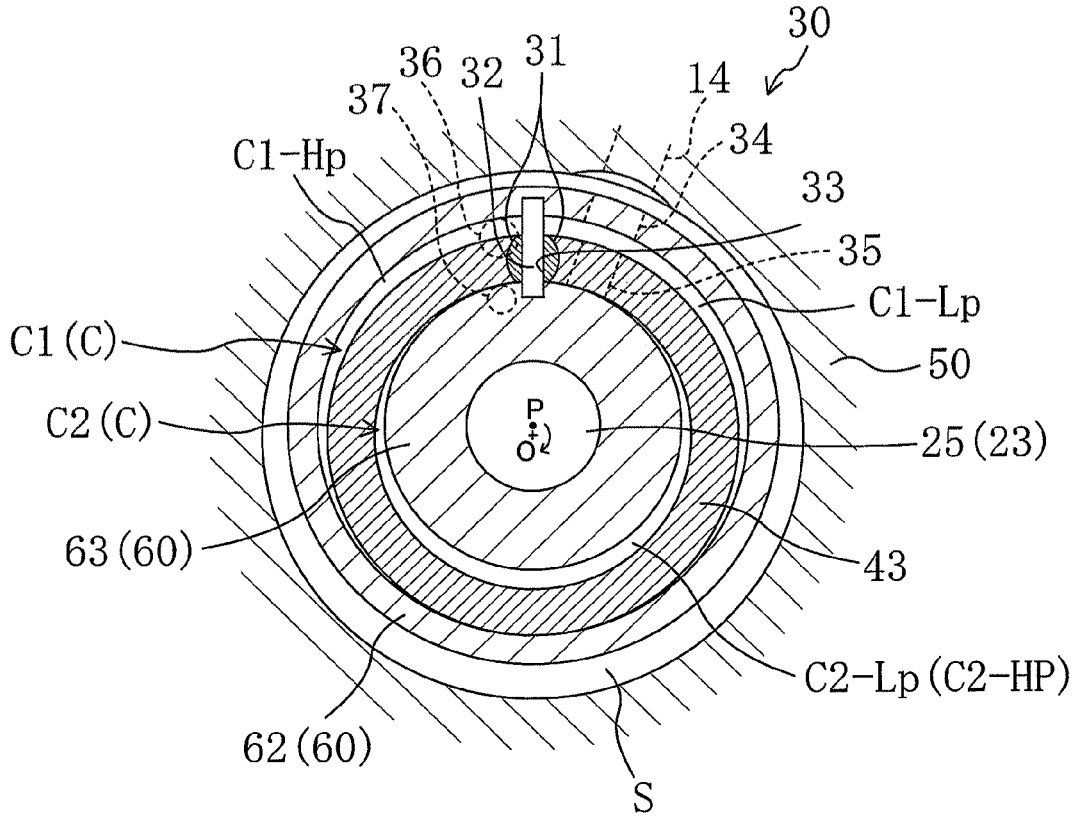
FIG. 2 is a transverse cross-sectional view of a compression mechanism of the compressor according to the first embodiment.

As shown in FIG. 2, the space blocked off by the front and the rear head (40) and (50) is divided by the cylinder (60) into two spaces. These two spaces are respectively an invalid space (S) and a cylinder chamber (C) which is in the shape of a ring. The invalid space (S) is defined between the inner peripheral surface of the rear head (50) and the outer cylinder part (62). The cylinder chamber (C) is defined between the inner peripheral surface of the outer cylinder part (62) and the outer peripheral surface of the inner cylinder part (63).

The other end of the suction pipe (14) is connected to the invalid space (S). The invalid space (S) is a space for ensuring the radius of turn of the outer cylinder part (62) and refrigerant is never compressed in the invalid space (S).

The ring-shaped piston (43) is arranged in the cylinder chamber (C). The outer peripheral surface of the ring-shaped piston (43) substantially comes into line contact through a microgap with the inner peripheral surface of the outer cylinder part (62), and at a position shifted in phase by 180° from the point of contact between the outer peripheral surface of the ring-shaped piston (43) and the inner peripheral surface of the outer cylinder part (62), the inner peripheral surface of the ring-shaped piston (43) substantially comes into line contact through a microgap with the outer peripheral surface of the inner cylinder part (63). In other words, the ring-shaped cylinder chamber (C) is divided by the ring-shaped piston (43) into an outer cylinder chamber (C1) and an inner cylinder chamber (C2). The outer cylinder chamber (C1) is defined between the inner peripheral surface of the outer cylinder part (62) and the outer peripheral surface of the ring-shaped piston (43). On the other hand, the inner cylinder chamber (C2) is defined between the inner peripheral surface of the ring-shaped piston (43) and the outer peripheral surface of the inner cylinder part (63).

A pair of swinging bushes (31) and a blade (32) are disposed in the decoupled portion of the ring-shaped piston (43).

The pair of swinging bushes (31) constitute a coupling member by which the ring-shaped piston (43) and the blade (32) are coupled together such that they are movable relative to each other. Each swinging bush (31) is formed so as to have a transverse cross-section in the shape of a semi circle. And, in each swinging bush (31), formed between the mutually opposing flat surfaces is a blade groove (33) for holding the blade (32) in such a manner that the blade (32) is allowed to move backward and forward in the radial direction. In addition, the circular arc-shaped outer peripheral surface formed on the outside of each swinging bush (31) constitutes a surface of sliding contact with the ring-shaped piston (43). Each swinging bush (31) is swingably held by the ring-shaped piston (43) while being in sliding contact, at its circular arc-like outer peripheral surface, with the ring-shaped piston (43).

The blade (32) extends from the inner peripheral-side wall surface of the outer cylinder part (62) to the outer peripheral-side wall surface of the inner cylinder part (63). The outer end of the blade (32) is engaged into an engagement groove formed in the inner peripheral surface of the outer cylinder part (62) while the inner end thereof is engaged into an engagement groove formed in the outer peripheral surface of the inner cylinder part (63). Furthermore, the lower surface side of the blade (32) is engaged into an engagement groove formed in the upper surface of the second end plate (61). In this way, the blade (32) is firmly secured to the cylinder (60), while being in engagement with the engagement grooves of the second end plate (61), the outer cylinder part (62), and the inner cylinder part (63). And, with the eccentric rotation of the cylinder (60), the blade (32) divides each of the outer and the inner cylinder chamber (C1) and (C2) into a high pressure chamber (C1-Hp, C2-Hp) and a low pressure chamber (C1-Lp, C2-Lp) (see FIG. 3).

The compression mechanism (30) is provided with a first and a second suction port (34) and (35) through which refrigerant is drawn into each low pressure chamber (C1-Lp, C2-Lp) from the outside. The compression mechanism (30) is further provided with a first and a second discharge port (36) and (37) through which refrigerant in each high pressure chamber (C1-Hp, C2-Hp) is discharged to the outside.

The first suction port (34) is formed in the outer cylinder part (62). The first suction port (34) establishes fluid communication between the invalid space (S) connected to the suction pipe (14) and the outer low pressure chamber (C1-Lp). The second suction port (35) is formed in the inner cylinder part (63). The second suction port (35) establishes fluid communication between the outer low pressure chamber (C1-Lp) and the inner low pressure chamber (C2-Lp).

As shown in FIG. 1, the first and the second discharge port (36) and (37) are formed in the first end plate (41) of the front head (40). The lower end of the first discharge port (36) opens to the outer high pressure chamber (C1-Hp) while the lower end of the second discharge port (37) opens to the inner high pressure chamber (C2-Hp). On the other hand, the upper end of each of the first and the second discharge port (36) and (37) opens to a space on the side of the electric motor (20) in the casing (10). Each discharge port (36, 37) is provided, at its upper end, with a respective reed valve (38, 39). Each reed valve (38, 39) constitutes a discharge valve which is opened when the pressure in its associated high pressure chamber (C1-Hp, C2-Hp) equals or exceeds a predetermined value. Furthermore, mounted above each discharge port (36, 37) is a muffler (27) for reducing the pressure pulsation of discharged refrigerant.

Running Operation

Figure 3:
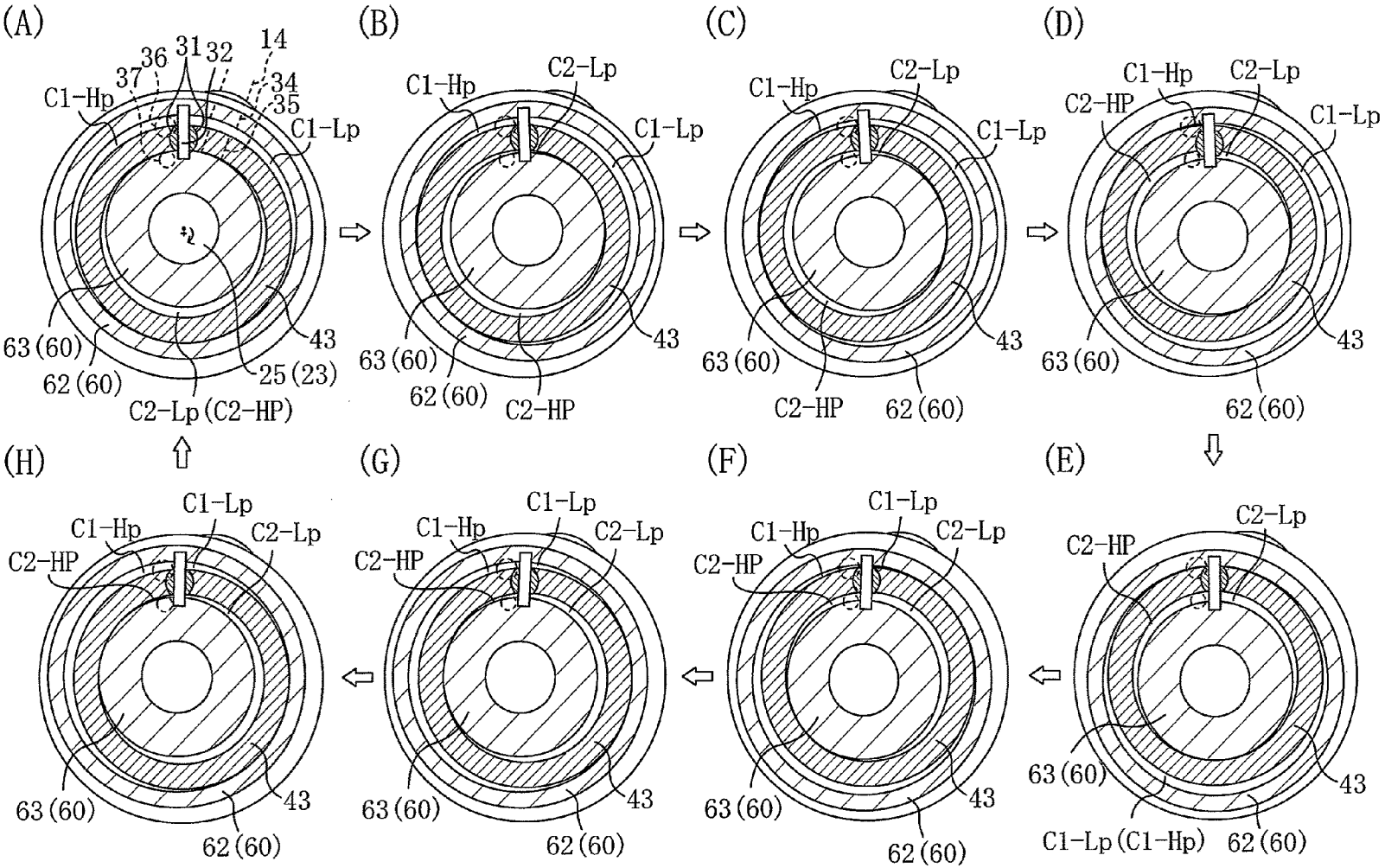
FIG. 3 is an operation diagram of the compression mechanism of the compressor according to the first embodiment.

Next, the running operation of the compressor (1) is described with reference to FIG. 3. When the electric motor (20) is activated to rotate the drive shaft (23), the resulting rotational force is transmitted through the eccentric part (25) to the cylinder (60). As a result, in the compression mechanism (30), the cylinder (60) is rotated eccentrically relative to the fixed-side ring-shaped piston (43).

During the eccentric rotation of the cylinder (60), the outer and the inner cylinder part (62) and (63) move backward and forward together with the blade (32) while swinging together with the swinging bushes (31), and the cylinder (60) turns about the axial center, O, of the drive shaft (23) as an eccentric-rotation center. As a result, the point of contact between the inner peripheral surface of the outer cylinder part (62) and the outer peripheral surface of the ring-shaped piston (43), and the point of contact between the outer peripheral surface of the inner cylinder part (63) and the inner peripheral surface of the ring-shaped piston (43) are displaced clockwise while remaining shifted in phase by 180° from each other.

In the outer cylinder chamber (C1), the volume of the low pressure chamber (C1-Lp) is reduced substantially to a minimum in the state from FIG. 3(E) to FIG. 3(F). From this state, the drive shaft (23) rotates clockwise to cause the cylinder (60) to turn as shown sequentially in FIGS. 3(G), (H), (A), (B), (C), (D), and (E), and the volume of the low pressure chamber (C1-Lp) gradually increases. As a result, refrigerant is drawn, through the suction pipe (14), the invalid space (S), and the first suction port (34), into the low pressure chamber (C1-Lp). When the cylinder (60) completes one turn and turns further from the state of FIG. 3(F), the suction of refrigerant into the low pressure chamber (C1-Lp) comes to an end. Then, this low pressure chamber (C1-Lp) now becomes a high pressure chamber (C1-Hp) for the compression of refrigerant, and there is defined across the blade (32) a new low pressure chamber (C1-LP).

Upon the further turn of the cylinder (60), refrigerant is gradually drawn into the low pressure chamber (C1-Lp) while the volume of the high pressure chamber (C1-Hp) decreases, and refrigerant is compressed in the high pressure chamber (C1-Hp). And, when the pressure in the high pressure chamber (C1-Hp) equals or exceeds a predetermined value, the reed valve (38) of the first discharge port (36) is opened, and the high pressure refrigerant is discharged, as discharged refrigerant, to outside the compression mechanism (30).

In the inner cylinder chamber (C2), the volume of the low pressure chamber (C2-Lp) is reduced substantially to a minimum in the state from FIG. 3(A) to FIG. 3(B). When, from this state, the drive shaft (23) rotates clockwise to cause the cylinder (60) to turn as shown sequentially in FIGS. 3(C), (D), (E), (F), (G), (H), and (A), the volume of the low pressure chamber (C2-Lp) gradually increases. As a result, refrigerant is drawn, through the suction pipe (14), the invalid space (S), the first suction port (34), and the second suction port (35), into the low pressure chamber (C2-Lp). When the cylinder (60) completes one turn and turns further from the state of FIG. 3(B), the suction of refrigerant into the low pressure chamber (C2-Lp) comes to an end. Then, this low pressure chamber (C2-Lp) becomes a high pressure chamber (C2-Hp) for the compression of refrigerant, and there is defined across the blade (32) a new low pressure chamber (C2-LP).

Upon the further turn of the cylinder (60), refrigerant is gradually drawn into the low pressure chamber (C2-Lp) while the volume of the high pressure chamber (C2-Hp) decreases, and refrigerant is compressed in the high pressure chamber (C2-Hp). And, when the pressure in the high pressure chamber (C2-Hp) equals or exceeds a predetermined value, the reed valve (39) of the second discharge port (37) is opened, and the high pressure refrigerant is discharged, as discharged refrigerant, to outside the compression mechanism (30).

The high pressure refrigerant discharged, as described above, from each discharge port (36, 37) passes through around the periphery of the muffler (27) and around the periphery of the electric motor (20) and then passes and flows through the discharge pipe (15). And, the refrigerant which has flowed out to outside the casing (10) from the discharge pipe (15) undergoes, in the refrigerant circuit, a condensation process, an expansion process, and an evaporation process and then is drawn again into the compressor (1). Here, since both the discharge ports (36, 37) and the discharge pipe (15) face the space on the side of the electric motor (20), the high-temperature, high-pressure refrigerant discharged from the discharge ports (36, 37) will not flow around the periphery of the compression mechanism (30) but is sent to outside the casing (10). Consequently, the undesirable situation that the fluid in each low pressure chamber (C1-Lp, C2-Lp) of the compression mechanism (30) is heated by the refrigerant discharged from the discharge ports (36, 37) to result in a drop in the compression efficiency of the compression mechanism (30), is inhibited.

Positional Relationship/Design Size of Each Component Part

As described above, the compression mechanism (30) is configured such that the inner peripheral surface of the outer cylinder part (62) and the outer peripheral surface of the ring-shaped piston (43) substantially come into line contact through a microgap with each other while, at a position shifted in phase by 180 degrees from the point of contact between the inner peripheral surface of the outer cylinder part (62) and the outer peripheral surface of the ring-shaped piston (43), the outer peripheral surface of the inner cylinder part (63) and the inner peripheral surface of the ring-shaped piston (43) substantially come into line contact through a microgap with each other.

However, if, due to the influence caused by the assembly error of the compression mechanism (30), the interval of the microgap between the cylinder (60) and the ring-shaped piston (43) changes depending on the eccentric position of the cylinder (60), this causes trouble in the compression mechanism (30). More specifically, if the microgap is expanded too much, this causes refrigerant leakage from between the cylinder (60) and the ring-shaped piston (43), thereby producing the possibility that the compression efficiency of the compression mechanism (30) may drop. On the other hand, if the microgap is narrowed too much, this increases the sliding resistance of the point of contact between the cylinder (60) and the ring-shaped piston (43), thereby creating the possibility that wear and seizing may occur in the contact point.

In the first embodiment, in order to reduce as much as possible the radial shift between the cylinder (60) and the ring-shaped piston (43) at the time of assembling the compression mechanism (30), the fixed-side ring-shaped piston (43) and the main bearing (45) are formed integrally with each other. Regarding this point, description will be made below in detail.

In the first place, as shown in FIG. 1, the movable-side cylinder (60) is coupled to the eccentric part (25) of the drive shaft (23). In the cylinder (60), both the center of the outer cylinder part (62) and the center of the inner cylinder part (63) coincide with the axial center, P, of the eccentric part (25) while on the other hand the eccentric-rotation center of the outer cylinder part (62) and the eccentric-rotation center of the inner cylinder part (63) coincide with the axial center, O, of the drive shaft (23). Here, the drive shaft (23) is supported by the main bearing (45) and the axial center, O, of the drive shaft (23) is restricted by the main bearing (45), so that the eccentric-rotation center position of the cylinder (60) is determined substantially by the position of the main bearing (45).

On the other hand, the fixed-side ring-shaped piston (43) is formed integrally with the front head (40). Here, in the front head (40), the relative position between the ring-shaped piston (43) and the main bearing (45) is determined such that the center of the ring-shaped piston (43) and the axial center, O, of the drive shaft (23) coincide with each other. Stated another way, like the eccentric-rotation center position of the cylinder (60), the center position of the ring-shaped piston (43) is determined substantially by the position of the main bearing (45).

As described above, in the present embodiment, both the position of the movable-side cylinder (60) and the position of the fixed-side ring-shaped piston (43) are restricted by the main bearing (45). Consequently, the undesirable situation that the eccentric-rotation center of the cylinder (60) and the center of the ring-shaped piston (43) shift in the radial direction due to the assembly error of the compression mechanism (30), is eliminated.

In addition, in the present embodiment, the axial length (bearing length) of the surface of the main bearing (45) which surface comes into sliding contact with the drive shaft (23) is set longer than the bearing length of the sub bearing (51). Besides, in the present embodiment, the radial bearing gap between the main bearing (45) and the drive shaft (23) is set narrower than the bearing gap of the sub bearing (51). As a result, the radial position and the inclination of the drive shaft (23) are restricted substantially by the main bearing (45) without being interfered with by the sub bearing (51). As a result, the eccentric-rotation center position of the cylinder (60) is restricted substantially by the main bearing (45), thereby effectively inhibiting the center of the ring-shaped piston (43) and the eccentric-rotation center of the cylinder (60) from shifting in the radial direction.

Advantageous Effects of the First Embodiment

In the first embodiment, the fixed-side ring-shaped piston (43) and the main bearing (45) are formed integrally with each other. Consequently, in accordance with the present embodiment, it becomes possible that both the radial position of the fixed-side ring-shaped piston (43) and the radial position of the movable-side cylinder (60) are restricted by the main bearing (45). As a result, the undesirable situation that the eccentric-rotation center position of the cylinder (60) and the center position of the ring-shaped piston (43) shift radially due to the assembly error of the compression mechanism (30), is inhibited. That is, in accordance with the first embodiment, if the dimension accuracy of each component part such as the front head (40), the cylinder (60) et cetera is ensured, it becomes possible to equalize the interval of the microgap between the cylinder (60) and the ring-shaped piston (43), without the need for precise alignment of the relative position of the ring-shaped piston (43) and the cylinder (60). Accordingly, the assembling of the compression mechanism (30) is facilitated and, in addition, fluid leakage from between the cylinder (60) and the ring-shaped piston (43) and wear/seizing at the point of contact between the cylinder (60) and the ring-shaped piston (43) are prevented, thereby making it possible to enhance the reliability of the compressor (1).

In addition to the above, in the first embodiment, the drive shaft (23) is supported, in a straddle manner, by both the main bearing (45) and the sub bearing (51). Consequently, in accordance with the present embodiment, it becomes possible to reduce the bearing load carrying capacity exerting on both the bearings of the drive shaft (23), and the drive shaft (23) is stably rotated.

Additionally, in the first embodiment, the bearing length of the main bearing (45) is set longer than the bearing length of the sub bearing (51). Consequently, the movable-side cylinder (60) is restricted mainly by the main bearing (45). Accordingly, the undesirable situation that the position of the cylinder (60) is restricted by the mount position of the main bearing (45) to cause the eccentric-rotation center of the cylinder (60) and the center of the ring-shaped piston (43) to shift in the radial direction, is inhibited.

Furthermore, in accordance with the first embodiment, the bearing gap of the main bearing (45) is set narrower than the bearing gap of the sub bearing (51), thereby making it possible to effectively inhibit the eccentric-rotation center of the cylinder (60) and the center of the ring-shaped piston (43) from shifting in the radial direction.

Second Embodiment of the Invention

A rotary compressor in accordance with a second embodiment of the present invention differs in the configuration of the compression mechanism (30) from the compressor (1) of the first embodiment. More specifically, for the case of the compression mechanism (30) of the first embodiment, the movable-side cylinder (60) is rotated eccentrically relative to the fixed-side ring-shaped piston (43). On the other hand, for the case of the compression mechanism (30) of the second embodiment, the ring-shaped piston (43) serving as a movable side is rotated eccentrically relative to the cylinder (60) serving as a fixed side. With regard to the compressor (1) of the second embodiment, the difference from the first embodiment will be described below.

Figure 4:
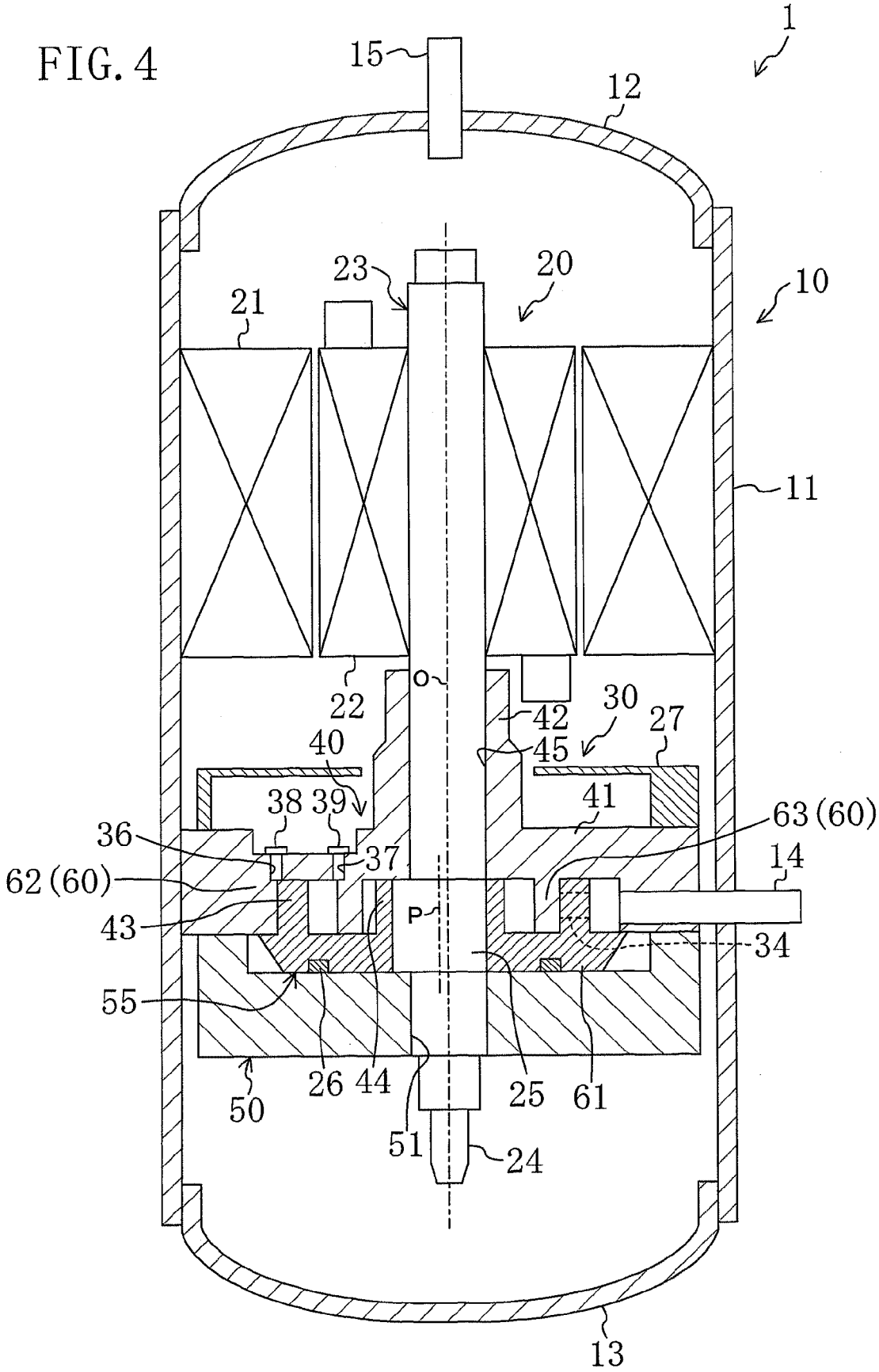
FIG. 4 is a longitudinal cross-sectional view of a compressor according to a second embodiment of the present invention.

As shown in FIG. 4, the front head (40) is configured such that it includes the first end plate (41), the main bearing (45), and the cylinder (60) which are integrally formed with each other. The cylinder (60) is made up of the outer cylinder part (62) in the shape of a circular plate which is formed so as to project downwardly from the outer peripheral end of the first end plate (41), and the inner cylinder part (63) in the shape of a circular plate which is formed so as to project downwardly from the radial intermediate position of the first end plate (41). The center of the outer cylinder part (62) and the center of the inner cylinder part (63) radially coincide with the axial center, O, of the drive shaft (23). In addition, the suction pipe (14) is extended through the outer cylinder part (62) from its radial outside.

On the other hand, the eccentric movable part (55) is made up of the second end plate (61), the ring-shaped piston (43), and an eccentric bearing member (44). The ring-shaped piston (43) is formed so as to project upwardly from the surface on the outer peripheral side of the second end plate (61). On the other hand, the eccentric bearing member (44) is formed so as to project upwardly from the inner peripheral end of the second end plate (61). The eccentric bearing member (44) is formed in the shape of a ring for the eccentric part (25) to be engaged therein. Upon the rotation of the drive shaft (23), the ring-shaped piston (43) is, together with the eccentric bearing member (44) and the second end plate (61), rotated eccentrically relative to the cylinder (60). Here, the center of the ring-shaped piston (43) coincides with the axial center, P, of the eccentric part (25) while on the other hand the eccentric-rotation center of the ring-shaped piston (43) coincides with the axial center, O, of the drive shaft (23).

Figure 5:
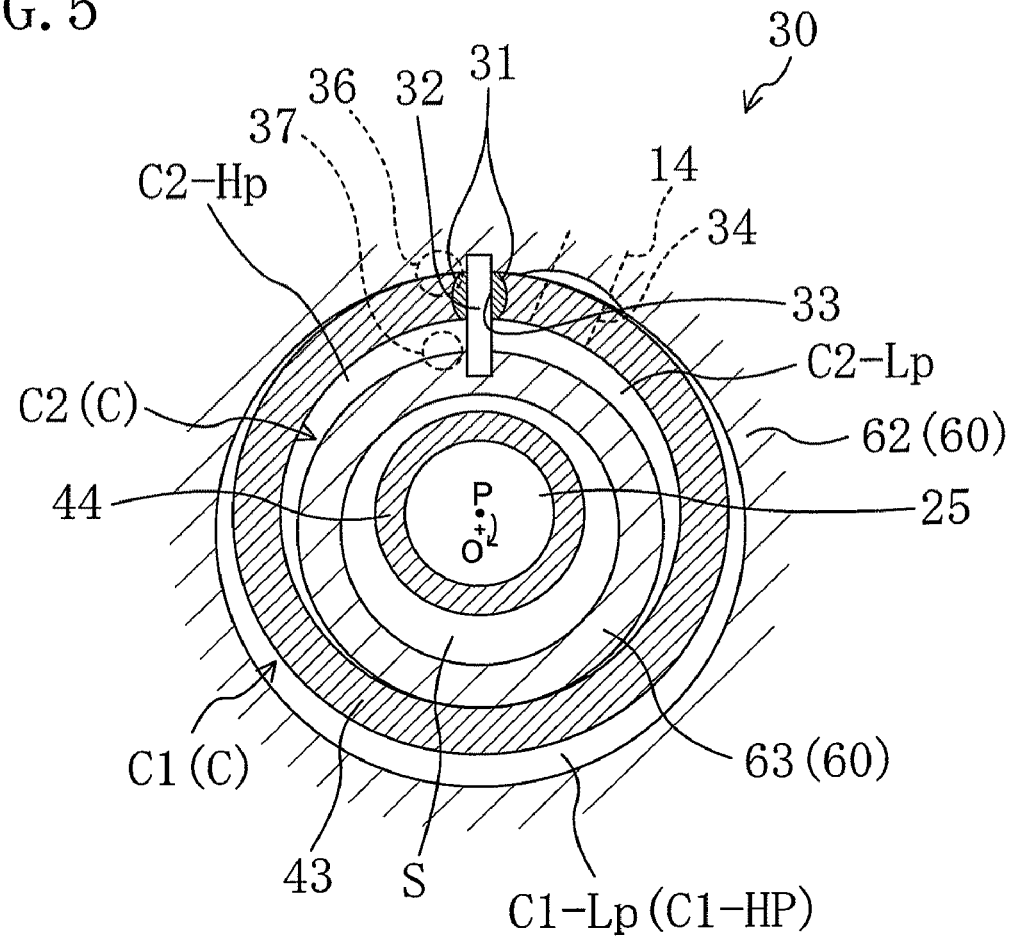
FIG. 5 is a transverse cross-sectional view of a compression mechanism of the compressor according to the second embodiment.

As shown in FIG. 5, the cylinder chamber (C) in the shape of a ring is defined between the inner peripheral surface of the outer cylinder part (62) and the outer peripheral surface of the inner cylinder part (63). The cylinder chamber (C) is divided by the ring-shaped piston (43) into the outer cylinder chamber (C1) and the inner cylinder chamber (C2). On the other hand, the invalid space (S) is defined between the inner peripheral surface of the inner cylinder part (63) and the outer peripheral surface of the eccentric bearing member (44). The invalid space (S) is a space for ensuring the radius of turn of the eccentric bearing member (44) and is blocked off from the cylinder chamber (C).

As in the first embodiment, the paired swinging buses (31) and the blade (32) are disposed in the decoupled portion of the ring-shaped piston (43). In the second embodiment, the blade (32) is firmly secured to the fixed-side cylinder (60). And, each swinging bush (31) moves backward and forward in the direction in which the blade (32) extends while on the other hand the ring-shaped piston (43) swings along the circular arc-shaped outer peripheral surface of each swinging bush (31).

The compression mechanism (30) is provided with the suction port (34) through which refrigerant is drawn into each low pressure chamber (C1-Lp, C2-Lp) from the outside. The compression mechanism (30) is further provided with the first and the second discharge port (36) and (37) through which refrigerant in each high pressure chamber (C1-Hp, C2-Hp) is discharged to the outside. The suction port (34) is formed in the ring-shaped piston (43) and establishes fluid communication between the outer cylinder chamber (C1) and the inner cylinder chamber (C2). On the other hand, the first and the second discharge port (36) and (37) are formed in the first end plate (41), as in the first embodiment.

As described above, in the compressor (1) of the second embodiment, the fixed-side cylinder (60) is formed integrally with the main bearing (45), and the movable-side ring-shaped piston (43) is coupled to the drive shaft (23) supported by the main bearing (45). In addition, also in the second embodiment, the bearing length of the main bearing (45) is set longer than the bearing length of the sub bearing (51) and the bearing gap of the main bearing (45) is set narrower than the bearing gap of the sub bearing (51), as in the first embodiment.

Running Operation

Figure 6:
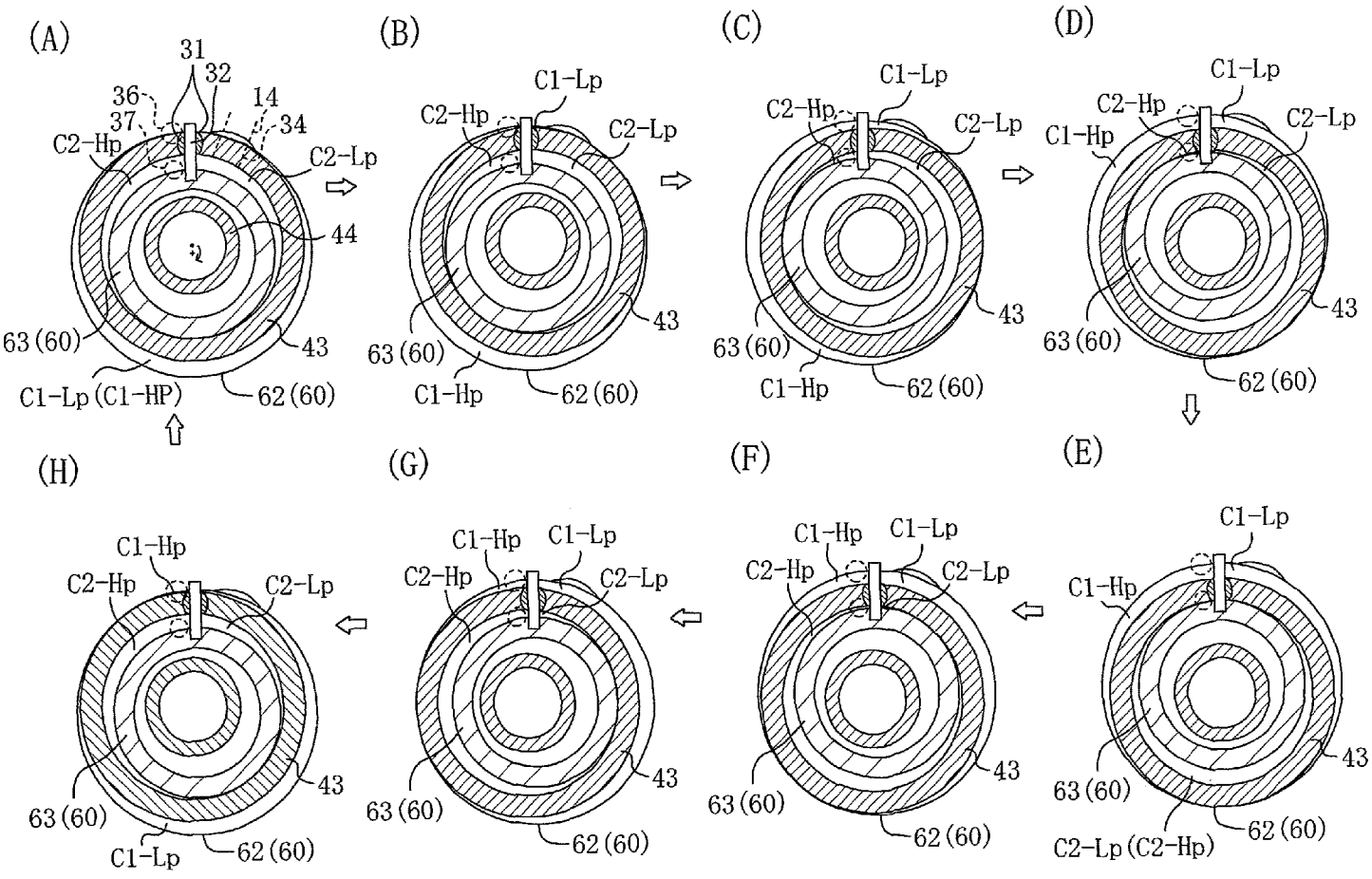
FIG. 6 is an operation diagram of the compression mechanism of the compressor according to the second embodiment.

Next, referring to FIG. 6, the running operation of the compressor (1) of the second embodiment is described. When the electric motor (20) is activated to rotate the drive shaft (23), the resulting rotational force is transmitted through the eccentric part (25) to the ring-shaped piston (43). As a result, in the compression mechanism (30), the ring-shaped piston (43) is rotated eccentrically relative to the fixed-side cylinder (60).

During the eccentric rotation of the ring-shaped piston (43), the ring-shaped piston (43) swings with respect to the swinging bushes (31) while moving backward and forward with respect to the blade (32), and turns about the axial center, O, of the drive shaft (23) as an eccentric-rotation center. As a result, the point of contact between the inner peripheral surface of the outer cylinder part (62) and the outer peripheral surface of the ring-shaped piston (43), and the point of contact between the outer peripheral surface of the inner cylinder part (63) and the inner peripheral surface of the ring-shaped piston (43) are displaced clockwise while remaining shifted in phase by 180° from each other.

In the outer cylinder chamber (C1), the volume of the low pressure chamber (C1-Lp) is reduced substantially to a minimum in the state from FIG. 6(A) to FIG. 6(B). From this state, the drive shaft (23) rotates clockwise to cause the ring-shaped piston (43) to turn as shown sequentially in FIGS. 6(C), (D), (E), (F), (G), (H), and (A), and the volume of the low pressure chamber (C1-Lp) gradually increases. As a result, refrigerant is drawn through the suction pipe (14) into the low pressure chamber (C1-Lp). When the ring-shaped piston (43) completes one turn and turns further from the state of FIG. 6(B), the suction of refrigerant into the low pressure chamber (C1-Lp) comes to an end. Then, this low pressure chamber (C1-Lp) now becomes a high pressure chamber (C1-Hp) for the compression of refrigerant, and there is defined across the blade (32) a new low pressure chamber (C1-LP).

Upon the further rotation of the ring-shaped piston (43), refrigerant is gradually drawn into the low pressure chamber (C1-Lp) while the volume of the high pressure chamber (C1-Hp) decreases, and refrigerant is compressed in the high pressure chamber (C1-Hp). And, when the pressure in the high pressure chamber (C1-Hp) equals or exceeds a predetermined value, the reed valve (38) of the first discharge port (36) is opened, and the high pressure refrigerant is discharged, as discharged refrigerant, to outside the compression mechanism (30).

In the inner cylinder chamber (C2), the volume of the low pressure chamber (C2-Lp) is reduced substantially to a minimum in the state from FIG. 6(E) to FIG. 6(F). When, from this state, the drive shaft (23) rotates clockwise to cause the ring-shaped piston (43) to turn as sequentially shown in FIGS. 6(G), (H), (A), (B), (C), (D), and (E), and the volume of the low pressure chamber (C2-Lp) gradually increases. As a result, refrigerant is drawn, through the suction pipe (14) and the first suction port (34), into the low pressure chamber (C2-Lp). When the ring-shaped piston (43) completes one turn and turns further from the state of FIG. 6(F), the suction of refrigerant into the low pressure chamber (C2-Lp) comes to an end. Then, this low pressure chamber (C2-Lp) now becomes a high pressure chamber (C2-Hp) for the compression of refrigerant, and there is defined across the blade (32) a new low pressure chamber (C2-LP).

Upon the further rotation of the ring-shaped piston (43), refrigerant is gradually drawn into the low pressure chamber (C2-Lp) while the volume of the high pressure chamber (C2-Hp) decreases, and refrigerant is compressed in the high pressure chamber (C2-Hp). And, when the pressure in the high pressure chamber (C2-Hp) equals or exceeds a predetermined value, the reed valve (39) of the second discharge port (37) is opened, and the high pressure refrigerant is discharged, as discharged refrigerant, to outside the compression mechanism (30).

The high pressure refrigerant discharged, as described above, from each discharge port (36, 37) passes through around the periphery of the muffler (27) and around the periphery of the electric motor (20) and then passes and flows through the discharge pipe (15). And, the refrigerant which has flowed out to outside the casing (10) from the discharge pipe (15) undergoes, in the refrigerant circuit, a condensation process, an expansion process, and an evaporation process and then is drawn again into the compressor (1).

Advantageous Effects of the Second Embodiment

In the second embodiment, the fixed-side cylinder (60) and the main bearing (45) are formed integrally with each other. Consequently, in accordance with the second embodiment, it becomes possible that both the radial position of the fixed-side cylinder (60) and the radial position of the movable-side ring-shaped piston (43) are restricted by the main bearing (45). As a result, the undesirable situation that the eccentric-rotation center position of the ring-shaped piston (43) and the center position of the cylinder (60) shift radially due to the assembly error of the compression mechanism (30), is inhibited. Accordingly, the assembling of the compression mechanism (30) is facilitated and, in addition, fluid leakage from between the cylinder (60) and the ring-shaped piston (43) and wear/seizing at the point of contact between the cylinder (60) and the ring-shaped piston (43) are prevented.

In addition, also in the second embodiment, it is set such that, as in the first embodiment, the bearing length of the main baring (45) is longer than the bearing length of the sub bearing (51) and the bearing gap of the main bearing (45) is narrower than the bearing gap of the sub bearing (51). This arrangement of the second embodiment impedes the movable-side ring-shaped piston (43) to be interfered with by the sub bearing (51), thereby making it possible that the ring-shaped piston (43) is restricted mainly by the main bearing (45). Accordingly, the undesirable situation that the eccentric-rotation center of the ring-shaped piston (43) shifts from the center of the cylinder (60) due to the mount error and the machining accuracy error of the sub bearing (51), is effectively inhibited.

Another Embodiment

With respect to the above-described embodiments, the present invention may be configured as follows.

Figure 7:
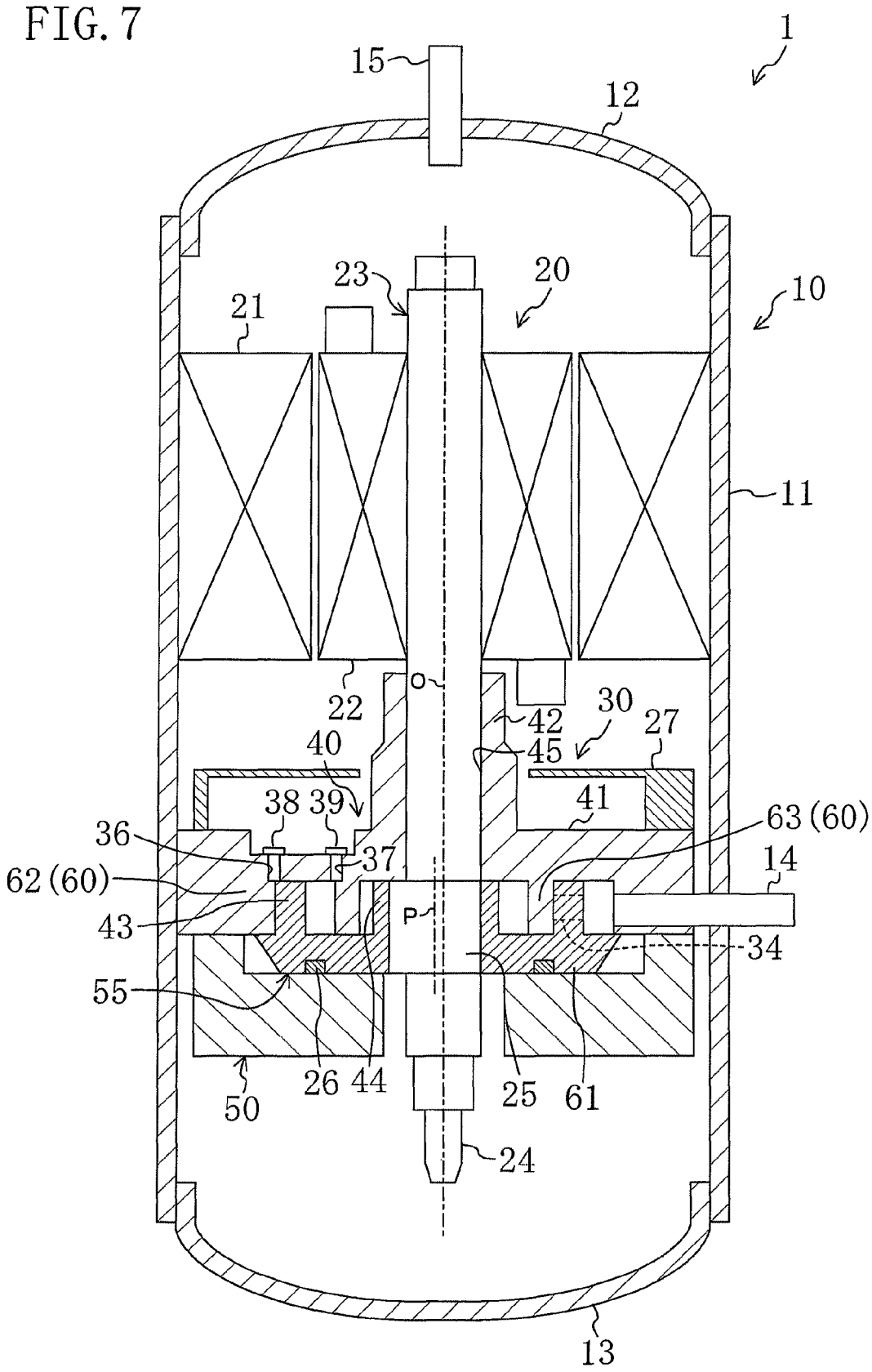
FIG. 7 is a longitudinal cross-sectional view of a compressor according to another embodiment of the present invention.
Figure 8:
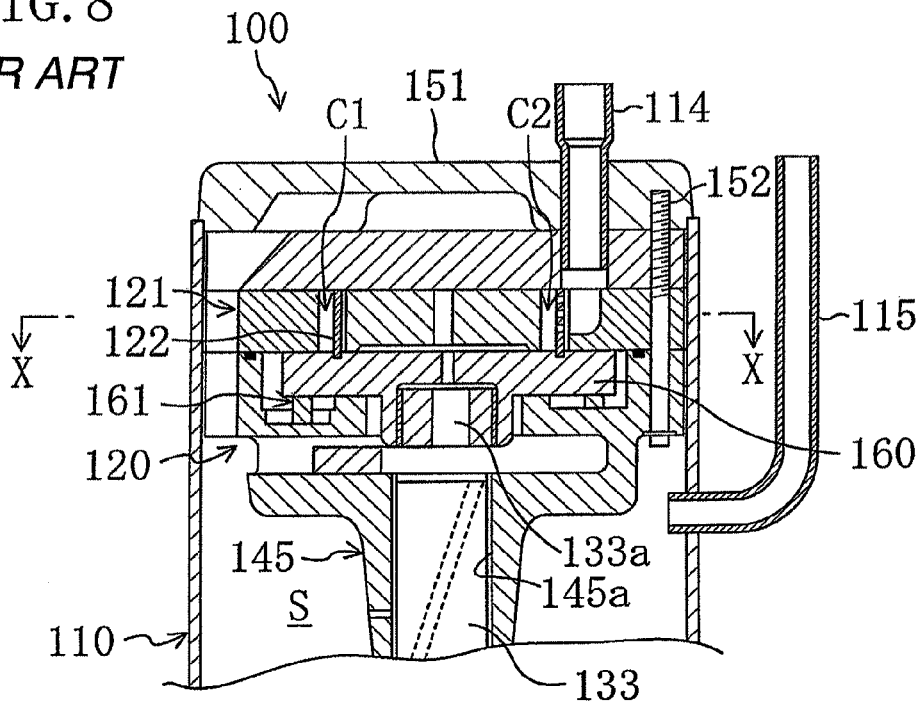
FIG. 8 PRIOR ART
FIG. 8 is a longitudinal cross-sectional view of a principle section of a conventional exemplary compressor.
Figure 9:
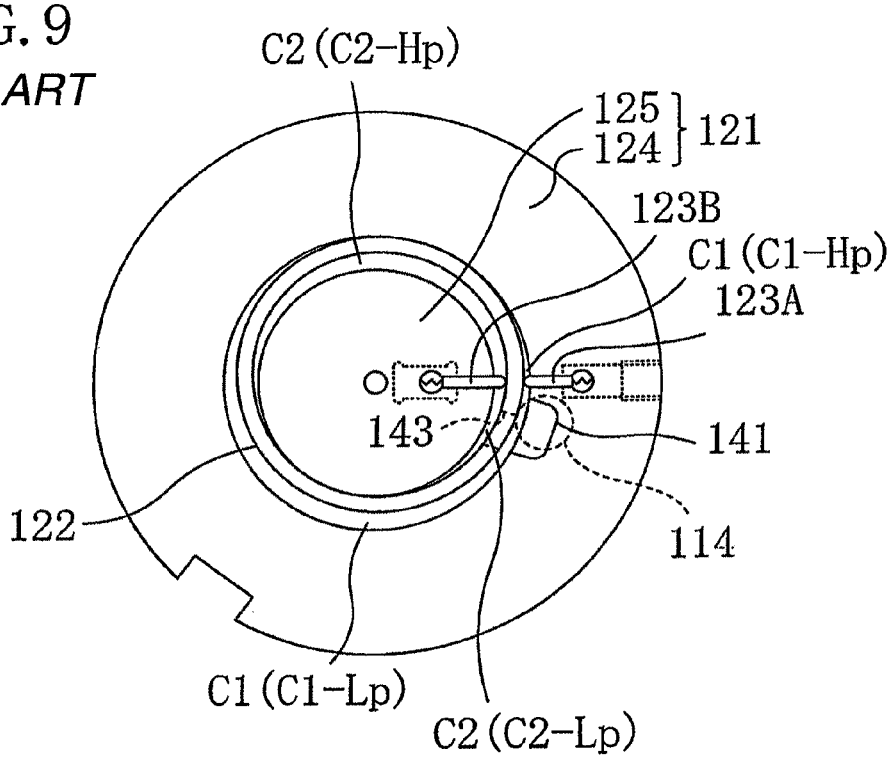
FIG. 9 PRIOR ART
FIG. 9 is a transverse cross-sectional view of a compression mechanism of the conventional exemplary compressor.

In the first and the second embodiment, it is arranged such that the drive shaft (23) is supported by both the main bearing (45) and the sub bearing (51). However, as an example shown in FIG. 7, the drive shaft (23) may be supported only by the main bearing (45) without the provision of the sub bearing (51). More specifically, although in the example of FIG. 7 the drive shaft (23) is passed through the rear head (50), the inner wall of a through hole in the rear head (50) and the outer peripheral surface of the drive shaft (23) are completely separated from each other through a predetermined interval, and no sub bearing is provided. In this configuration, the radial position and the inclination of the drive shaft (23) are restricted completely only by the main bearing (45), thereby making it possible to further ensure that the eccentric-rotation center of the movable-side ring-shaped piston (43) and the center of the cylinder (60) coincide with each other. Also note that, although FIG. 7 shows an example about the compression mechanism (30) in which the ring-shaped piston (43) is rotated eccentrically relative to the cylinder (60) as in the second embodiment, it may be configured such that the sub bearing (51) is not provided with respect to the compression mechanism (30) (e.g., an example of the first embodiment) in which the cylinder (60) is rotated eccentrically relative to the ring-shaped piston (43).

In addition, in the above-described embodiments, the compression mechanism (30) underlies the electric motor (20), and the main bearing (45) which extends upwardly towards the electric motor (20) from the compression mechanism (30) is formed integrally with either the cylinder (60) or the ring-shaped piston (43), whichever is the fixed side. Alternatively, it may be arranged such that the compression mechanism (30) overlies the electric motor (20), and the main bearing (45) which extends downwardly towards the electric motor (20) from the compression mechanism (30) is formed integrally with either the cylinder (60) or the ring-shaped piston (43), whichever is the fixed side. Also in this case, the same effects as accomplished in the first and the second embodiment are obtained.

It should be noted that the above-described embodiments are essentially preferable exemplifications which are not intended in any sense to limit the scope of the present invention, its application, or its application range.

INDUSTRIAL APPLICABILITY

As has been described above, the present invention is useful for a rotary compressor in which a ring-shaped piston is arranged in a ring-shaped cylinder chamber of a cylinder, the ring-shaped piston dividing the cylinder chamber into an outer and an inner cylinder chamber, and in which the cylinder and the ring-shaped piston are rotated eccentrically relative to each other.

What is claimed is:

1. A rotary compressor comprising:

an eccentric-rotation type piston mechanism including a cylinder with a ring-shaped cylinder chamber, a ring-shaped piston eccentricly disposed in the cylinder chamber to divide the cylinder chamber into an outer cylinder chamber and an inner cylinder chamber, and a blade arranged in the cylinder chamber to divide each of the outer and the inner cylinder chambers into a high pressure chamber and a low pressure chamber, the cylinder and the ring-shaped piston being movable eccentrically relative to each other with one of the cylinder and the ring-shaped piston serving as a movable side and the other one of the cylinder and ring-shaped piston serving as a fixed side;

a drive shaft coupled to the one of the cylinder and the ring-shaped piston serving as the movable side with the movable side being moved in response to rotation of the drive shaft about a rotation axis, the drive shaft including an eccentric part arranged and configured to engage with the one of the cylinder and the ring-shaped piston serving as the movable side; and a drive mechanism coupled to the drive shaft to rotate the drive shaft in response to operation of the drive mechanism, the one of the cylinder and the ring-shaped piston serving as the fixed side including a main bearing which supports the drive shaft in a rotatable manner on a drive mechanism side in the eccentric-rotation type piston mechanism, the main bearing being integrally formed as a unitary part of the one of the cylinder and the ring-shaped piston serving as the fixed side, and the outer cylinder chamber, the inner cylinder chamber and the eccentric part being formed on a common plane perpendicular to the rotation axis.

2. The rotary compressor of claim 1, wherein the drive shaft extends so as to pass axially through the eccentric-rotation type piston mechanism, and the rotary compressor further comprises a sub bearing which supports the drive shaft in a rotatable manner on an axially opposite side of the eccentric-rotation type piston mechanism from the drive mechanism side, wherein the main bearing is axially longer than the sub bearing.

3. The rotary compressor of claim 2, further comprising a casing having the eccentric-rotation type piston mechanism, the drive shaft, the drive mechanism and a fluid discharged from the eccentric-rotation type piston mechanism disposed therein;

a discharge pipe connected to the casing to lead the fluid discharged from the eccentric-rotation type piston mechanism out of the casing from a space within the casing, the space within the casing extending from the eccentric-rotation type piston mechanism towards the drive mechanism; and a fixed-side member including the main bearing and the one of the cylinder and the ring-shaped piston serving as the fixed side, the fixed side member being provided with a discharge port of the eccentric-rotation type piston mechanism.

4. The rotary compressor of claim 1, wherein a main bearing gap formed between the main bearing and the drive shaft is narrower than a sub bearing gap formed between a sub bearing and the drive shaft.

5. The rotary compressor of claim 4, further comprising a casing having the eccentric-rotation type piston mechanism, the drive shaft, the drive mechanism and a fluid discharged from the eccentric-rotation type piston mechanism disposed therein;

a discharge pipe connected to the casing to lead the fluid discharged from the eccentric-rotation type piston mechanism out of the casing from a space within the casing, the space within the casing extending from the eccentric-rotation type piston mechanism towards the drive mechanism; and a fixed-side member including the main bearing and the one of the cylinder and the ring-shaped piston serving as the fixed side, the fixed side member being provided with a discharge port of the eccentric-rotation type piston mechanism.

6. The rotary compressor of claim 1, further comprising a casing having the eccentric-rotation type piston mechanism, the drive shaft, the drive mechanism and a fluid discharged from the eccentric-rotation type piston mechanism disposed therein;

a discharge pipe connected to the casing to lead the fluid discharged from the eccentric-rotation type piston mechanism out of the casing from a space within the casing, the space within the casing extending from the eccentric-rotation type piston mechanism towards the drive mechanism; and a fixed-side member including the main bearing and the one of the cylinder and the ring-shaped piston serving as the fixed side, the fixed side member being provided with a discharge port of the eccentric-rotation type piston mechanism.

* * * * *